United States Patent [19]

Gioffre

[11] Patent Number: 4,526,583

[45] Date of Patent: Jul. 2, 1985

[54] POWDERED CARPET TREATING COMPOSITIONS

[75] Inventor: Anthony J. Gioffre, Ridgefield, Conn.

[73] Assignee: Union Carbide Corporation, Danbury, Conn.

[21] Appl. No.: 521,454

[22] Filed: Aug. 8, 1983

[51] Int. Cl.[3] ..... D06M 11/04; C11D 17/00

[52] U.S. Cl. ..... 8/137; 252/8.8; 252/90; 252/11; 252/506

[58] Field of Search ..... 252/8.8, 90; 8/137, 8/142

[56] References Cited

U.S. PATENT DOCUMENTS

| | | | |
|---|---|---|---|
| 4,161,449 | 7/1979 | Smith et al. | 252/8.8 |
| 4,244,834 | 1/1981 | Schwalley et al. | 252/106 |
| 4,304,675 | 12/1981 | Corey et al. | 8/142 |

*Primary Examiner*—Maria Parrish Tungol

*Attorney, Agent, or Firm*—Gary L. Wamer

[57] ABSTRACT

Powdered carpet treating compositions and the method of their use. Carpet treating compositions having improved anti-static, anti-microbial and anti-soiling characteristics are provided by use of an aluminosilicate pretreated with an anti-static agent, preferably a catonic surfactant, as a critical component in the formulation of the powdered carpet treating compositions.

24 Claims, 1 Drawing Figure

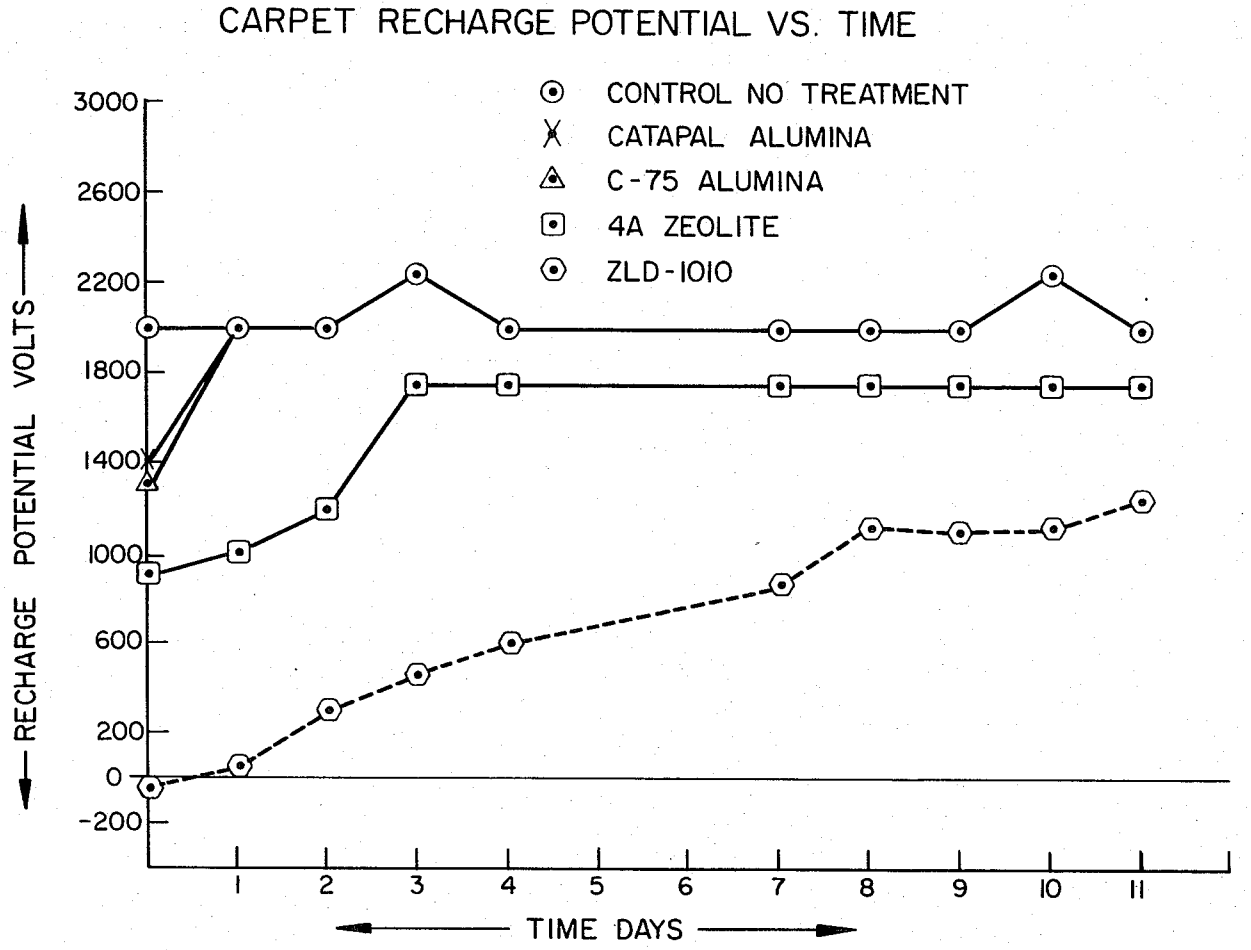
CARPET RECHARGE POTENTIAL VS. TIME
CONTROL NO TREATMENT
CATAPAL ALUMINA
C-75 ALUMINA
4A ZEOLITE
ZLD-1010
RECHARGE POTENTIAL VOLTS
3000
2600
2200
1800
1400
1000
600
200
0
-200
1
2
3
4
5
6
7
8
9
10
11
TIME DAYS

POWDERED CARPET TREATING COMPOSITIONS

FIELD OF THE INVENTION

The instant invention relates to powdered treating compositions and the method of employing such. The instant compositions employ aluminosilicates which have been pretreated with an antistatic agent, preferably as cationic surfactant, in the powdered carpet treating compositions.

BACKGROUND OF THE INVENTION

The present invention relates to powdered carpet treating compositions and the method for employing such in the treatment, e.g., cleaning and deodorizing, etc., of carpets. The compositions are useful in providing a carpet with anti-static, anti-soiling and anti-microbial characteristics.

The prior art discloses carpet cleaning compositions wherein mixtures of various components have been formulated to give a variety of results. For example, U.S. Pat. No. 4,161,449, issued to Smith et al. on July 17, 1979, discloses a powdered deodorizing composition for carpets containing an inorganic carrier such as sulfate or chloride of a particular particle size, a solid agglomerating agent, such as starch, a fragrance and optionally to about 15% of an anti-static agent which is preferably aluminum oxide. The composition of Smith et al. is disclosed as minimizing the dust produced by such a composition during the process of its removal from the carpet, i.e., by vacuuming, and is also stated to be effective in minimizing the difficulty of removal of the composition from the carpet owing to a decreased level of agglomeration by the composition.

U.S. Pat. No. 4,304,675, issued Dec. 8, 1981 to Corey et al., discloses a powdered carpet treating composition. Claim 1 of U.S. Pat. No. 4,304,675 reads as follows:

"1. A powdered carpet treating composition having stable rheological properties consisting essentially of a blend of:

(a) a major amount in respect of each of the individual components in the composition of an inorganic salt selected from the group consisting of sulfates, bicarbonates, chlorides and mixtures thereof;

(b) an effective deodorizing amount of a fragrance;

(c) an anti-static and rhenological control agent selected from a group consisting of natural and synthetic zeolites in which, said material being used in an effective amount sufficient to impart anti-static properties to the composition and control the rhenological properties of the composition; and (d) an effective agglomerating amount of a substantially non-fragrant liquid agglomerating agent;

wherein (1) a weight ratio component (c) to component (d) is from between about 30.0:1.0 and about 0.5:1.0;

(2) the critical flow value of the blend is between about 5.0 and about 30.0 grams when stored in a closed container at temperatures up to about 120° F. for at least 30 days; and (3) the effective fragrance imparting properties of the composition is maintained for at least 30 days when stored in a closed container at temperatures up to about 120° F."

The above claimed composition clearly requires that a major amount of the powdered carpet treating composition comprise an inorganic salt selected from the group consisting of sulfates, bicarbonates, chlorides and mixtures thereof. Unfortunately, the patentee did not appreciate the significant benefit which can be imparted to a powdered carpet treating composition by use of natural and synthetic zeolites pre-treated with an effective amount of an anti-static agent, preferably a cationic surfactant.

In addition to the claimed components of U.S. Pat. No. 4,304,675, additional ingredients may be employed in the formulation of such carpet cleaning compositions, for example see column 3, lines 1 to 12, wherein the use of anti-static agents, fragrance compounds or components, subliming agents, anti-microbial agents, cleaning agents and fragrance volatility control materials are disclosed as generally employable as loaded liquids on the zeolitic component. As noted in column 6, lines 1, et seq. a quaternary ammonium compound may be employed as an agglomerating agent and is added after all the powdered ingredients are admixed (column 6, lines 42–45). Unfortunately, the patentee has failed to appreciate that it is extremely important and advantageous to employ in such powdered carpet treating compositions a zeolitic component pre-treated with a cationic surfactant.

U.S. Pat. No. 4,244,834 discloses dry carpet cleaning and deodorizing compositions comprising about 85 to 99.8% of hydrated sodium borate, about 0.2 to 15% of water-insoluble hydrated metal aluminosilicate and about 0.01 to 5 percent of perfume, said percentages by weight. In addition, the compositions may contain about 0.05 to 5% by weight of a cationic quaternary ammonium salt. When the ammonium salt is employed it is provided by mixture in the form of a solution, with the sodium borate and aluminosilicate components.

Applicants have discovered that by employing as the zeolitic component a natural or synthetic zeolite which has been pre-treated with an effective amount, preferably between 0.2 percent by weight and about 10.0 percent by weight of an antistatic agent, preferably a cationic surfactant, that improved anti-static, anti-microbial and anti-soiling properties can be obtained.

DESCRIPTION OF THE DRAWING

FIG. 1 shows the difference in static charge build-up for several carpet treating compositions.

SUMMARY OF THE INVENTION

The instant invention comprises improved powdered carpet treating compositions comprising the improvement of employing as the powdered carpet treating composition or as the zeolitic component in such a natural and/or synthetic zeolite treated with an effective amount, preferably between 0.2 percent by weight and about 10.0 by weight, of an anti-static agent, preferably a cationic surfactant. Effective amounts of aglomerating agents and deodorizing agents may be employed. The instant invention also relates to an improved process for treating carpets with such powdered carpet treating compositions. Other features of the improved powdered carpet treating compositions of this invention will be further discussed hereinafter.

DETAILED DESCRIPTION OF THE INVENTION

The instant invention generally comprises the improvement of employing a pre-treated natural and/or synthetic zeolite as a carpet treating compositions or as a critical component in carpet treating compositions wherein a natural or synthetic zeolite is employed. The natural and/or synthetic zeolite is treated with an effective amount of an anti-static agent, preferably a cationic surfactant. Further, the instant invention comprises carpet treating compositions wherein for the first time between 50 percent by weight to 100 percent by weight of the carpet treating composition comprises a cationic surfactant-treated zeolite. Carpet treating compositions as described in U.S. Pat. Nos. 4,161,449, 4,304,675 and 4,244,834, said patents being incorporated herein by reference thereto, may be improved by employing therein a natural and/or synthetic zeolites treated with an effective amount of an anti-static agent, preferably a cationic surfactant, in accordance with the instant invention.

It has been discovered that by preparing powdered carpet treating compositions such that they comprise or incorporate a pre-treated natural and/or synthetic zeolite as the zeolitic component that such carpet treating compositions have improved anti-static, anti-microbial and anti-soiling characteristics. It has been discovered that it is important that the zeolite be treated, e.g., coated, with the anti-static agent prior to addition of the zeolite or anti-static agent to a carpet treating composition when the treated, e.g. cationic surfactant-treated, zeolite is employed in carpet treating compositions formed of mixtures of ingredients. The observed improvement in reduction of static charge is synergistic in nature and the improvement in anti-soiling is contrary to the well known fact that certain anti-static agents, e.g. cationic surfactants such as quaternary ammonium compounds, tend to increase soiling when employed in dry carpet treating compositions. It is believed that by pre-treating the zeolite with the anti-static agent, e.g., a cationic surfactant such as a quaternary ammonium compound, that the zeolite and anti-static agent combine to enhance the beneficial characteristics of each while decreasing detrimental characteristics of each, such as the resoiling characteristics of cationic surfactants.

The natural and/or zeolitic material used in accordance with this invention may be any of the natural and/or synthetic zeolites of the formula:

$$Na_z[(AlO_2)_z(SiO_2)_y]xH_2O$$

wherein z and y are integers the molar ratio of y to s is in the range from 1.0 to 1,000, x is an integer having a value of from about 8 to about 264 such that. In general such as zeolites are synthetic zeolites of a formula: These compounds have been generally disclosed in R. F. Gould, "Molecular Sieve Zeolites-1, Advances in Chemistry Series 101."American Chemical Society, Washington, D.C., (1971). And in D. W. Breck, "Zeolite Molecular Sieves: Structure, Chemistry and Use"; by John Wiley & Sons, Inc. (1974). Particularly useful zeolites for use in carpet treating compositions include zeolites A, X, Y, mordenite, erionite, clinoptilolite and chabazite.

When the "pre-treated zeolite" is employed as a component in a carpet treating composition the natural and/or synthetic zeolites are treated with an effective amount of an anti-static agent, preferably, between 0.2 percent and about 10.0 percent, and more preferably an effective amount between about 0.5 percent and 5 percent by weight. The zeolite is necessarily pre-treated prior to admixture with the remaining components of the powdered carpet treating composition(s). Further, it has been discovered that by pre-treating the aluminosilicate (zeolite) component with an anti-static agent comprising a cationic surfactant that improved anti-static, anti-microbial and anti-soiling characteristics can be imparted to the powdered carpet treating composition. In addition, it is believed that improved rhenological control properties may be provided by use of such a pre-treated aluminosilicate component. Further, by use of a pre-treated zeolite, it has been discovered that the zeolite component can be employed in an amount in excess of the level of zeolites employed in the prior art compositions, i.e., may be used in amounts in excess of 30% by weight based on the total weight of the powdered carpet treating composition.

The anti-static agents employed in treating the natural and/or synthetic aluminosilicates include, cationic surfactants, tertiary amine oxides, ethoxylated alcohols, alkyl phenols ethoxylated amines, phosphine oxides, anionic soaps, sulfates, sulfonates, zwitterionic quaternary ammonium compounds, silanes, and the like. The preferred anti-static agent is a cationic surfactant owing to the synergistic effect on static charge reduction that occurs when a cationic surfactant is employed to treat the natural and/or synthetic aluminosilicate(s).

Cationic surfactants employable herein for treating the natural and/or synthetic aluminosilicates are quaternary ammonium compounds of the general formula:

$$[R_1R_2R_3R_4N]^+Y^-$$

wherein at least one, but not more than two, of the "R" groups ($R_1$,' $R_2$, $R_3$ and/or $R_4$) is an organic radical containing a group selected from $C_8$–$C_{22}$ aliphatic radical, or an alkylphenyl or alkylbenzyl radical having 10 to 16 carbon atoms in the alkyl chain, the remaining group or groups being selected from $C_1$–$C_4$ alkyl, $C_2$–$C_4$ hydroxyalkyl, and cyclic structures in which the nitrogen atom forms part of the ring, Y constituting any salt-forming anion, preferably an anionic radical selected from the group consisting of hydroxide, halide, sulfate, carbonate, alkylsulfates, such as methylsulfate and ethylsulfate and phosphate ions.

The quaternary ammonium compounds employed as the cationic surfactant in this invention can be prepared in various ways well known in the art. Many such materials are commercially available. The quaternaries are often made from alkyl halide mixtures corresponding to the mixed alkyl chain lengths in fatty acids. For example, the "ditallow" quaternaries are made from alkyl halides having mixed $C_{14}$–$C_{18}$ chain lengths. Such mixed di-long chain quaternaries are useful herein and are preferred from a cost standpoint.

As noted above, essentially any anionic group can be the counter-ion in the quaternary compounds used herein. The anionic groups in the quaternary compounds can be exchanged, one for another, using standard anion exchange resins. Thus, quaternary ammonium salts having any desired anion are readily available for use in the instant invention. While it is believed that the nature of such anions has no effect on the compositions and processes of this invention halides, hydroxides, carbonates and sulfates are generally preferred.

The following are representative examples of cationic surfactants suitable for use in the compositions and processes of the instant invention. Ditallowdimethylammonium chloride is an especially preferred for use herein by virtue of its low cost, other useful di-long chain quaternary compounds are dicetyldimethylammonium chloride; bis-dicosyldimethylammonium chloride; didecyldemethylammonium chloride; ditallowdimethylammonium bromide; dioleoyldimethylammonium hydroxide; ditallowdiethylammonium chloride; ditallowdipropylammonium bromide; ditallowdibutylamonium flouride, cetyldecylmethylethylammonium chloride, bis[ditallowdimethylamonium]sulfate; tris[ditallowdimethylammonium]-phosphate; and the like.

The cationic surfactant treated aluminosilicates of the instant invention may be employed as carpet treating compositions or they may be incorporated into powdered carpet treating compositions in place of inorganic salts, aluminas and untreated zeolites, in which case such will be employed in admixture with agglomerating agents, and other auxiliary components such as subliming agents, cleaning agents, fragrances, and other building agents such as inorganic salts, including chlorides, sulfates, carbonates, bicarbonates, borates, citrates, phosphates, nitrates, and mixtures thereof, to name but a few. The agglomerating agents may be liquids or solid aglomerating agents, for example starch, silica powders, grain flour, wood flours, talc, pumice, clays and calcium phosphate. These agglomerating agents solid may be employed by use of the cationic surfactant-treated aluminosilicate. Further, it is surprising that by use of a cationic surfactant coated aluminosilicate that non-liquid agglomerating agents may be employed without the significant loss in rhenological properties disclosed in U.S. Pat. No. 4,304,675. (For example, see comparative examples 6 and 7 wherein zeolite 4A and an alumina salt were compared.)

The natural and/or synthetic aluminosilicates are treated with the anti-static agent by physically mixing the zeolite with the anti-static agent in the liquid or vapor phase. As a result of this physical admixture the anti-static agent is deposited or coated onto and/or into the aluminosilicate, although the exact nature of the association of the anti-static agent and the aluminosilicate is not clearly understood at present.

The above identified carpet treating compositions may be applied to a carpet from a shakeable canister or container having a top that contains openings whereby the product may be dispersed by shaking. Both the size and number of holes may vary and the top may have a closure that can regulate the number of holes being operated at any time. Thus, the amount of discharged product can be regulated by both the hole opening as well as the particular rhenological properties of the carpet cleaning composition. The container may be comprised of any material including plastics, such as polypropylene or polyacrylate or combinations thereof. The container may also be comprised of cardboard based on aluminum foil based materials including both inside and outside wax-coated laminations.

In the general process of providing the carpet treating compositions to a carpet the carpet cleaning composition is provided to a carpet by shaking from the container and spreading it throughout the carpet by means of vacuuming. Thus, the carpet and surrounding environment, including the vacuum cleaner, play in integral part in providing for the cleaning and/or deodorization of the carpet and surrounding environment.

The effective amount of carpet composition to be provided to a carpet depends on the odors present in the carpet, the particular carpet treating formulation, the desired treatment level, the strength of the fragrance in the treating composition, but in most cases will be between about 0.1 grams per square feet and about 5.0 grams per square feet of carpet.

The following examples are provided herein simply for the purpose of illustration and are not intended to be limited thereof. In the examples, all amounts are given with respect to their weight percent in the overall carpet cleaning composition, unless otherwise specified.

EXAMPLE 1

The improved anti-static characteristics of carpet treating compositions containing natural and/or synthetic zeolites coated with a cationic surfactant(s) was evaluated by measuring the charge on a carpet prior to treatment with any carpet treating composition and after treatment with carpet treating compositions A, B, C or D. Composition A is an untreated alumina (CATAPAL), composition B is an untreated alumina (C-75), composition C is zeolite 4A and composition D is a cationic surfactant-treated zeolite A4 (2 percent by weight cationic surfactant, anhydrous basis). The cationic-surfactant treatment was carried out by forming a slurry of the zeolite and the cationic surfactant. The cationic surfactant was dimethyldi(Hydrogenated-tallow)ammonium chloride. A control comprising a carpet which was not treated with any carpet treating composition was also evaluated.

The anti-static characteristics of each composition was evaluated by measuring the static charge of a 8"×8" swatch of carpet (Lees American Classic Antron III) with a Monroe Electronics Stat Arc (Model 230B) by fixing the probe of the Stat Arc one inch above the selected carpet swatch. The Control was tested by stroking the carpet swatch five times (one direction) with individual pieces of rubber tubing (8"×1¼") and the static charge measured with the Stat Arc. Each of the carpet swatches was similarly tested to determine that each swatch attained the comparable static charge of the Control in an untreated state. Each of four swatches were treated with one of each of compositions A, B, C and D, respectively. Each swatch was allowed to stand for one minute and vacuumed with three even vacuum cleaner strokes. Each swatch was again recharged (aforementioned five stroke procedure) and measured for static charge. After the initial static charge measurements the recharge procedure was repeated for the control and the swatches treated with compositions A, B, C and D and the static charge measured at comparable time periods. Static charge measurements were discontinued for a given swatch when the static charge was comparable to the Control. The results of these measurements are set forth in FIG. 1. FIG. 1 shows that the cationic surfactant-treated zeolite 4A (Composition D) initially achieved a significantly lower static charge and maintained a lower static charge with time.

EXAMPLE 2

The synergistic nature of cationic surfactant-treated aluminosilicates when employed in carpet treating compositions was evaluated by preparing three compositions, i.e., compositions E, F and G. Compositions E, F and G comprise 2 percent by weight dimethyldi(hydrogenated-tallow)ammonium chloride on a CATAPAL alumina, a C-75 alumina and a zeolite 4A, respectively. Comositions E, F and G were evaluated for static charge reduction according to the procedure of example 1 with a "Control" being similarly evaluated.

The initial charge on the Control was 2250 volts. The recharge of each treated carpet swatch was 900 volts (Composition E) 1275 volts (Composition F) and 25 volts (Composition G). It is significant that when the static charge reduction of the cationic surfactant-treated zeolite is compared to the cationic surfactant-treated alumina and the results of example 1, that the enhanced reduction in static charge of the cationic surfactant-treated zeolite cannot be attributed to simple additive effects of the cationic surfactant and the zeolite. This also shows that it is important to provide the cationic surfactant as a pre-treatment to the zeolite prior to addition to a carpet treating formulation.

After each of the carpet swatches had been tested for recharge the carpet swatches were weighted to determine what weight percent of each composition was remaining. Analysis showed that 60 percent of composition E and 52 percent of composition F were remaining on the carpet swatch after vacuuming while only 32 percent of composition G was left as residual powder. Thus, composition G was both more effective in reducing static charge build-up on the carpet and left substantially less residue on the vacuumed carpet.

EXAMPLE 3

The effect of the concentration of the anti-static agent employed to treat the aluminosilicate on the static charge recharge after treatment of the carpet was evaluated by testing four carpet swatches with four cationic surfactant-treated aluminosilicates (zeolite 4A). The cationic surfactant of example 1 was employed. The charges on the four swatches were measured 9 times over 15 days according to the procedure employed in example 1. The results of these measurements showed that even at concentrations as low as 1 percent by weight that the cationic surfactant-treated aluminosilicate was an effective static charge control agent over the fifteen day evaluation period, i.e., had an average recharge potential of less than 950 volts.

EXAMPLE 4

The average discharge rate of the cationic surfactant-treated zeolite 4A of example 1 was compared with an alumina by employing both at several concentrations (grams of the compositions per 8"×8" carpet swatch). The discharge rate was computed by measuring the initial static charge of each untreated swatch (2250 volts), and then treating the swatches and measuring the static charge after forty minutes. The discharge rate was then determined by the equation:

$$\text{Discharge Rate} = \frac{2250 \text{ volts} - V_{40}}{40 \text{ minutes}}$$

where $V_{40}$ is the static charge measurement in volts at forty minutes.

The results of these measurements showed that the cationic surfactant-treated zeolite showed a substantial increase in the discharge rate as the treatment amount increased from 0.01 grams per swatch to 0.2 grams per swatch while the swatches treated with comparable amounts of alumina showed no improvement in the discharge rate. The results of these measurements were:

| Composition[1] | Treatment Conc.[1] | Discharge Rate |
|---|---|---|
| Alumina | .01 | 25 |

-continued

| Composition[1] | Treatment Conc.[1] | Discharge Rate |
|---|---|---|
| Alumina | .03 | 25 |
| Alumina | .06 | 25 |
| Alumina | 0.1 | 25 |
| Alumina | 0.2 | 25 |
| CSTZ | .01 | 25 |
| CSTZ | .03 | 32 |
| CSTZ | .06 | 33.6 |
| CSTZ | 0.1 | 39.4 |
| CSTZ | 0.2 | 43 |

[1]CSTZ = cationic surfactant-treated zeolite
[2]Treatment concentration in grams of carpet treating composition per 8" × 8" carpet swatch.

The above data indicate that even at low treatment concentrations the cationic surfactant-treated zeolite had a larger discharge rate than alumina treatment concentrations several orders of magnitude larger.

EXAMPLE 5

The anti-soiling characteristics, i.e., the ability of a treated carpet to release deposited "dirt" upon vacuuming were evaluated for "Controls" and Compositions A and D of example 1 and an alumina. In addition, a commercially avaiable carpet treating composition containing alumina was evaluated (Composition J).

Carpet swatches were evaluated using 6"×6" swatches of white nylon carpet. The swatches were placed in a dry room (43% relative humidity at 79° F.) for seventy two hours prior to evaluation. Each swatch, except the controls, was then evenly treated with 1 gram of one of the carpet treating compositions. The compositions which were evaluated were compositions A and D of example 1, an alumina (composition H), and a commercially available carpet treating composition containing alumina (composition J). Two controls were evaluated with Control I being a swatch of the white nylon carpet and with Control II being a swatch treated with the two grams of the dirt employed in soiling all the soiled swatches of this example. Four swatches were treated with compositions A, D, H and J. Two grams of a dirt (sieved to less than 100 mesh (U.S. Standard)) were then evenly applied to the swatches, except for Control I. Each swatch was then vacuumed and evaluated by visual observation and by use of a reflectometer (Hunter Lab Model D 40). Visual observations indicated that composition D, according to this invention, showed the lowest amount of retained dirt, i.e., has the best anti-soiling characteristics as further indicated by a reflectometer measurement which was close to that measured for Control I.

Reflectometer measurements on the treated swatches were as follows:

TABLE I

| Composition | Reflectometer Measurement |
|---|---|
| Control I | 61.58 |
| Control II* | 53.31 |
| A* | 54.68 |
| D* | 61.29 |
| H* | 55.16 |
| J* | 58.50 |

*Average value of measurements of two carpet swatches and four reflectometer measurements per swatch.

The reflectometer measurements indicated that the cationic surfactant-treated aluminosilicate was substantially more effective in preventing retention of the dirt by the carpet, i.e., was superior in its anti-soiling characteristics.

I claim:

1. In a powdered carpet treating composition containing a natural or synthetic zeolite the improvement comprising pre-treating said zeolite with an effective amount of an anti-static agent.

2. The composition of claim 1 wherein the anti-static agent is a cationic surfactant.

3. The powdered carpet treating composition of claim 2 wherein said effective amount of cationic surfactant is between 0.2 percent by weight and 10.0 percent by weight based on the weight of the natural or synthetic zeolite.

4. In a powdered carpet-treating composition according to claim 1 comprising a blend of between about 40.0–98.99% by weight, of an inorganic salt carrier selected from the group consisting of sulfates, chlorides, carbonates, bicarbonates, borates, citrates, phosphates, nitrages and mixtures thereof, between about 1.0–25.0% by weight of an agglomerating agent selected from the group consisting of starch, silica powders, grain flour, wood flour, talc, pumice, clays and calcium phosphate, between about 0.0.–20.0% by weight of a volatile ordorous agent and up to about 15% by weight of an antistatic agent, the improvement comprising employing as the antistatic agent a natural or synthetic zeolite pre-treated with an effective amount of a cationic surfactant.

5. The composition of claim 4 wherein the anti-static agent is a cationic surfactant.

6. In a powdered carpet treating composition according to claim 1 consisting essentially of a blend of:

(a) a major amount in respect of each of the individual components in the composition of an inorganic salt selected from the group consisting of sulfates, bicarbonates, chlorides and mixtures thereof;

(b) an effective deodorizing amount of a fragrance;

(c) an anti-static and rhenological control agent selected from a group consisting of natural and synthetic zeolites in which, said material being used in an effective amount sufficient to impart anti-static properties to the compostion and control the rhenological properties of the composition; and (d) an effective agglomerating amount of a substantially non-fragrant liquid agglomerating agent;

wherein (1) a weight ratio component (c) to component (d) is from between about 30.0:1.0 and about 0.5:1.0;

(2) the critical flow value of the blend is between about 5.0 and about 30.0 grams when stored in a closed container at temperatures up to about 120° F. for at least 30 days; and (3) the effective fragrance imparting properties of the composition is maintained for at least 30 days when stored in a closed container at temperatures up to about 120° F.; the improvement comprising coating the zeolite with an effective amount of an anti-static agent.

7. The composition of claim 6 wherein the anti-static agent is a cationic surfactant.

8. In a dry carpet cleaning and deodorizing composition comprising about 85 to 99.8% by weight of hydrated sodium borate, about 0.2–15 percent by weight of water-insoluble hydrated metal aluminosilicate, 0.01 to 5 percent by weight perfume and 0.05 to 5 percent by weight of cationic quaternary ammonium salt, the improvement comprising treating the aluminosilicate with an effective amount of an anti-static agent prior to admixture with the hydrated sodium borate and perfume.

9. The composition of claim 8 wherein the anti-static agent is a cationic surfactant.

10. The powdered carpet treating composition of claims 2, 5, 7 or 9 wherein the cationic surfactant employed for coating aluminosilicate is a quaternary ammonium compound having the formula:

$$[R_1R_2R_3R_4N]^+Y^-$$

where at least one but not more than two of the R-groups is an organic radical containing a group selected from $C_8$–$C_{22}$ aliphatic radical, or an alkylphenyl or alkylbenzylradical having 10 to 16 carbon atoms in the alkyl chain, the remaining group or groups being selected from $C_1$–$C_4$ alkyl, $C_2$–$C_4$ hydroxyalkyl, and cyclic structures which the nitrogen atom forms part of the ring, Y constituting an anionic radical selected from the group consisting of hydroxide, halide, sulfate, methylsulfate, and phosphate anions.

11. Powdered carpet treating compositions of claims 1, 4, 6 or 8 wherein the aluminosilicate is selected from the group consisting of zeolites A, X and Y.

12. Composition according to claim 4 wherein an inorganic salt carrier is present in an amount between about 0.5% and about 20% by weight.

13. The composition according to claims 5, 7 or 9 wherein the effective amount of cationic surfactant is between about 0.2 percent and about 10.0 percent by weight, based on the weight of the zeolite.

14. The powdered carpet treating composition according to claim 6 wherein the effective amount of the deodorizing agent is between about 0.5 percent and about 5.0 percent by weight.

15. The method for treating a carpet which comprises applying to the carpet an effective amount of the composition according to claims 1, 4, 6 or 8.

16. The method for treating a carpet which comprises applying to the carpet an effective amount of the composition according to claims 2, 5, 7 or 9.

17. In the method for treating a carpet with powdered carpet treating compositions the improvement of applying to the carpet an effective amount of a composition according to claims 2, 5, 7 or 9 and removing said composition by means of a vacuum cleaner.

18. The powdered carpet treating composition consisting essentially of a natural or synthetic zeolite treated with between 0.2 percent and about 10.0 percent by weight of a cationic surfactant selected from a group consisting of quaternary ammonium salts having the formula:

$$[R_1R_2R_3R_4N]^+Y^-$$

where at least one but not more than two of the R-groups is an organic radical containing a group selected from $C_8$–$C_{22}$ aliphatic radical, or an alkylphenyl or alkylbenzylradical having 10 to 16 carbon atoms in the alkyl chain, the remaining group or groups being selected from $C_1$–$C_4$ alkyl, $C_2$–$C_4$ hydroxyalkyl, and cyclic structures which the nitrogen atom forms part of the ring, Y constituting an anionic radical selected from the group consisting of hydroxide, halide, sulfate, methylsulfate, and phosphate anions.

19. The powdered carpet treating composition of claim 18 wherein an effective deodorizing amount of a fragrance is employed.

20. The powdered carpet treating composition of claim 19 wherein the effective amount of the deodorizing agent is between about 0.5 percent and about 5.0 percent by weight.

21. A method for treating a carpet comprising applying to a carpet an effective amount of the composition of claim 18 and removing said composition with a vacuum cleaner.

22. In a carpet treating composition containing at least one natural or synthetic zeolite the improvement comprising pretreating said natural or sunthetic zeolite before incorporation into said carpet treating composition with an effective amount of a quaternary ammonium compound having the formula:

$$[R_1R_2R_3R_4N]^+Y^-$$

where at least one but not more than two of the R-groups is an organic radical containing a group selected from $C_8$–$C_{22}$ aliphatic radical, or an alkylphenol or alkylbenzol radical having 10 to 16 carbon atoms in the alkyl chain, the remaining group or groups being selected from $C_1$–$C_4$ alkyl, $C_2$–$C_4$ hydroxialkyl, and cyclic structures which the nitrogen atom forms part of the ring, Y constituting an anionic radical selected from the group consisting of hydroxide, halide, sulfate, methylsulfate, and phosphate anions.

23. The carpet treating composition of claim 22 wherein said effective amount is between 0.2 percent by weight and 10.0 percent by weight, based on the weight of the natural or synthetic zeolite.

24. The carpet treating composition of claim 23 wherein said effective amount is between 0.5 percent and about 5.0 percent by weight.

* * * * *

UNITED STATES PATENT AND TRADEMARK OFFICE

CERTIFICATE OF CORRECTION

PATENT NO. : 4,526,583

DATED : July 2, 1985

INVENTOR(S) : Anthony Joseph Gioffre

It is certified that error appears in the above-identified patent and that said Letters Patent is hereby corrected as shown below:

Col. 2, line 68, "compositions" should read -- composition --.

Col. 3, line 13, "zeolites" should read -- zeolite --.

Col. 3, line 50, delete "such as".

Col. 4, line 67, delete "an".

Col. 5, line 23, "aglomerating" should read -- agglomerating --.

Col. 6, line 66, "Comositions" should read -- Compositions --.

IN THE CLAIMS:

Col. 9, line 20, "nitrages" should read -- nitrates -- .

Col. 11, line 11, "sunthetic" should read -- synthetic --.

Signed and Sealed this

*Seventeenth* Day of *December 1985*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,526,583

DATED : July 2, 1985

INVENTOR(S) : Anthony Joseph Gioffre

It is certified that error appears in the above-identified patent and that said Letters Patent is hereby corrected as shown below:

IN THE ABSTRACT

Line 5, "catonic" should read -- cationic --.

IN THE SPECIFICATION

Col. 2, line 57, "aglomerating" should read -- agglomerating --.

Col. 5, line 7, "flouride" should read -- fluoride --.

IN THE CLAIMS

Col. 9, Claim 4, line 24, "0.0." should read -- 0.01 --.

Col. 9, Claim 4, lines 24-25, "ordorous" should read -- odorous --.

Col. 9, Claim 6, line 43, "compostion" should read -- composition --.

Signed and Sealed this

Twenty-sixth Day of April, 1988

*Attest:*

DONALD J. QUIGG

*Attesting Officer*

*Commissioner of Patents and Trademarks*